US009892665B2

(12) United States Patent
LeMay et al.

(10) Patent No.: US 9,892,665 B2
(45) Date of Patent: Feb. 13, 2018

(54) POLYGONAL UNIBODY POLE SIGN

(71) Applicants: Edouard Charles LeMay, Avondale, AZ (US); Andrew Wilfred LeMay, Avondale, AZ (US)

(72) Inventors: Edouard Charles LeMay, Avondale, AZ (US); Andrew Wilfred LeMay, Avondale, AZ (US)

(73) Assignee: Andrew Wilfred LeMay, Avondale, AZ (US)

( * ) Notice: Subject to any disclaimer, the term of this patent is extended or adjusted under 35 U.S.C. 154(b) by 0 days.

(21) Appl. No.: 14/850,898

(22) Filed: Sep. 10, 2015

(65) Prior Publication Data

US 2016/0098946 A1 Apr. 7, 2016

Related U.S. Application Data

(60) Provisional application No. 62/049,653, filed on Sep. 12, 2014.

(51) Int. Cl.
*G09F 15/00* (2006.01)

(52) U.S. Cl.
CPC ..... *G09F 15/0037* (2013.01)

(58) Field of Classification Search
CPC ..... B65D 85/54; D65D 5/0254; A47F 5/112; G09F 1/06
See application file for complete search history.

(56) References Cited

U.S. PATENT DOCUMENTS 646,630 A * 4/1900 Watson ..... A47F 5/112 206/485
1,954,006 A * 4/1934 Wolf ..... B65D 85/52 206/423
2,664,670 A * 1/1954 Mulford ..... B65D 75/54 206/423
2,959,339 A * 11/1960 Sierk ..... B65D 5/0254 206/446
4,353,179 A * 10/1982 Jennings ..... G09F 7/22 40/431
5,597,070 A * 1/1997 Wu ..... B65D 5/504 206/419

* cited by examiner

*Primary Examiner* — Cassandra H Davis

(57) ABSTRACT

A Polygonal Unibody Pole Sign is a single piece of cardboard, or other flexible semi-rigid material, designed to enclose a pole, post, or column, that can remain elevated without adhesives, or external support while providing surfaces for advertising, display, or decoration. Installation does not require the Polygonal Unibody Pole Sign to be placed over the top of the pole, column or beam. Instead, the invention is wrapped around the support and kept enclosed by inserting tabs at one vertical end into slots in the other. Flaps with circular or other shaped aperture the same diameter of the support in place along the horizontal ends of each display panel are then folded inward to enclose the support and hold the invention at height. The final installed Polygonal Unibody Pole Sign then presents display surfaces visible from multiple directions, providing 360 degree visibility in the preferred enclosed embodiment.

1 Claim, 6 Drawing Sheets

POLYGONAL UNIBODY POLE SIGN

CROSS-REFERENCE TO RELATED APPLICATIONS

Figure 1:
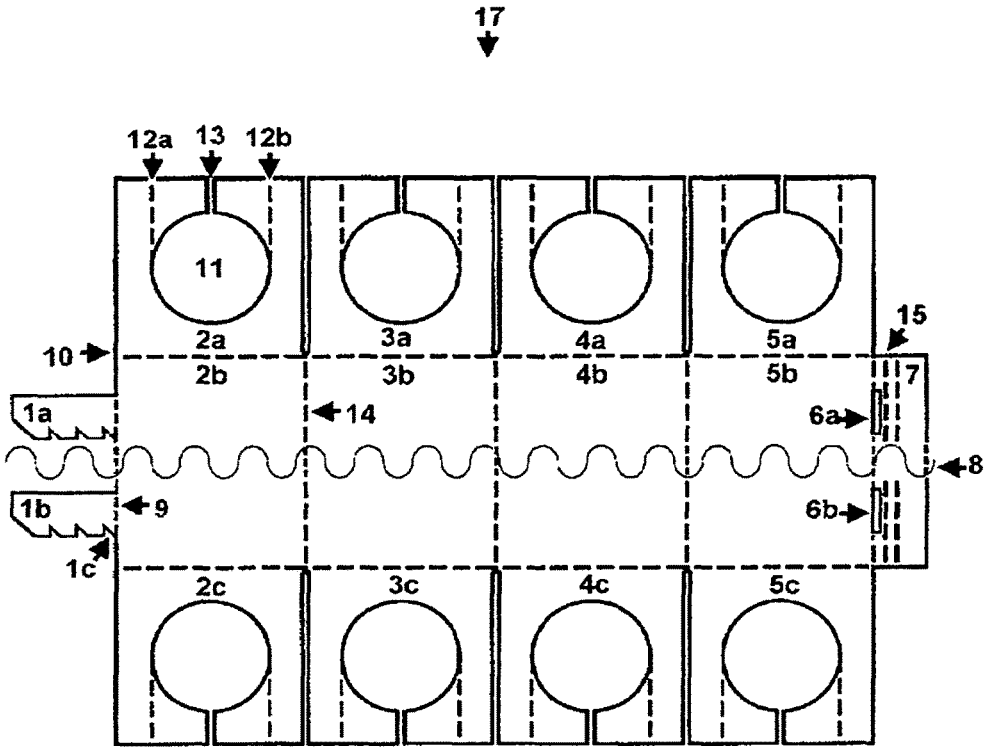

Provisional Application No. 62/049,653
Receipt Date: 12 Sep. 2014
Non-Provisional application Ser. No. 14/850,898 Receipt Date: 10 Sep. 2015

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

As of the sixth day of May two thousand and sixteen, there has been no public disclosure of the Polygonal Unibody Pole Sign (PUPS) by the Inventor or Co-Inventor.

BACKGROUND OF THE INVENTION

U.S. PATENT DOCUMENTS

| | Document Number Country Code-Number-Kind Code | Date MM-YYYY | Name | CPC Classification | US Classification |
|---|---|---|---|---|---|
| A | U.S.-646,630 A | 04-1900 | Watson, C. L. | A47F5/112 | 206/485 |
| B | U.S.-1,954,006 A | 04-1934 | WOLF EDWARD C | B65D85/52 | 206/423 |
| C | U.S.-2,664,670 A | 01-1954 | MULFORD MARION R | B65D75/54 | 2061423 |
| D | U.S.-2,959,339 A | 11-1960 | SIERK RAYMOND H | B65D5/0254 | 206/446 |
| E | U.S.-4,353,179 A | 10-1982 | Jennings; Hugh F. | G09F7/22 | 40/431 |
| F | U.S.-5,597,070 A | 01-1997 | Wu; Gordon K. H. | B65D5/504 | 206/419 |

BRIEF SUMMARY OF THE INVENTION

The Polygonal Unibody Pole Sign (PUPS) solves the problem of how to suspend a message high upon a long wood, metal, or concrete object, such as flag pole, light post, column, etc, without requiring additional support in the form of adhesives, attachments, or additional parts or pieces; and because a Polygonal Unibody Pole Sign is made from a single blank of semi-rigid material, which requires no additional parts to assemble, giving it a low cost advantage.

BRIEF DESCRIPTION OF THE SEVERAL VIEWS OF THE DRAWING(S)

FIG. 1—Is a plan view of an embodiment of the present invention.

Figure 2:
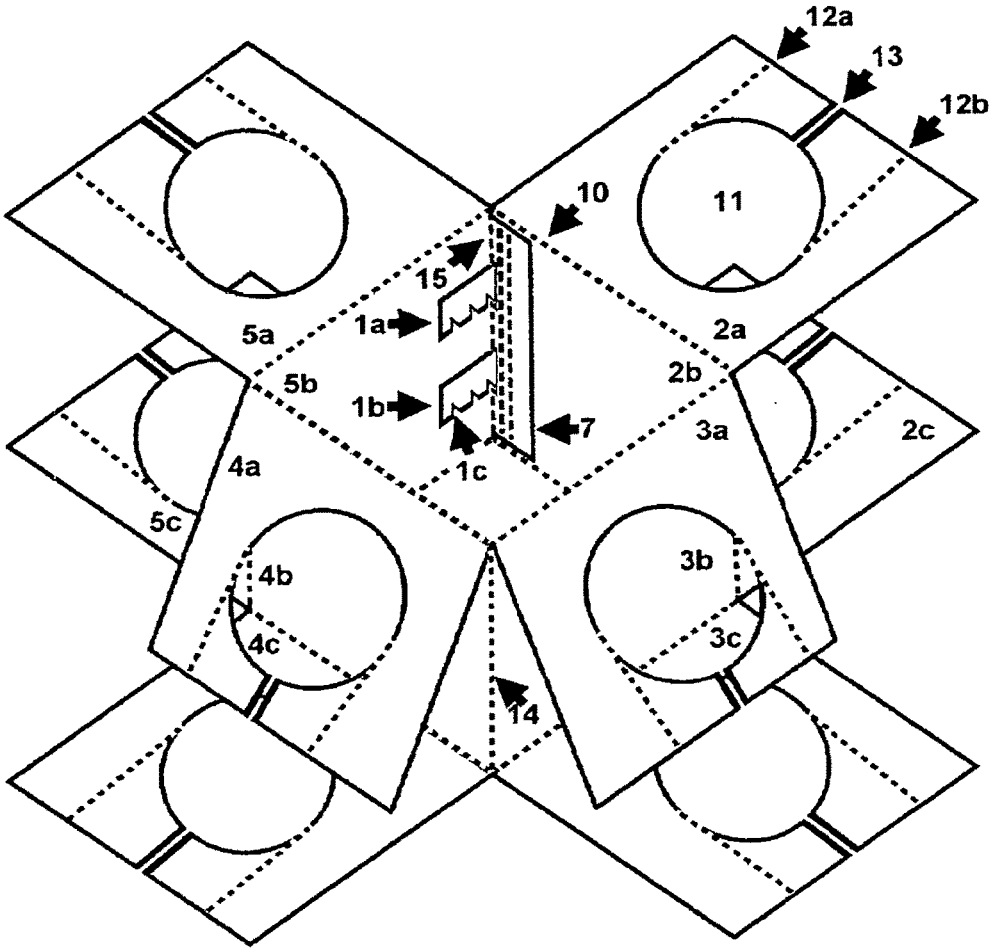
Figure 3:
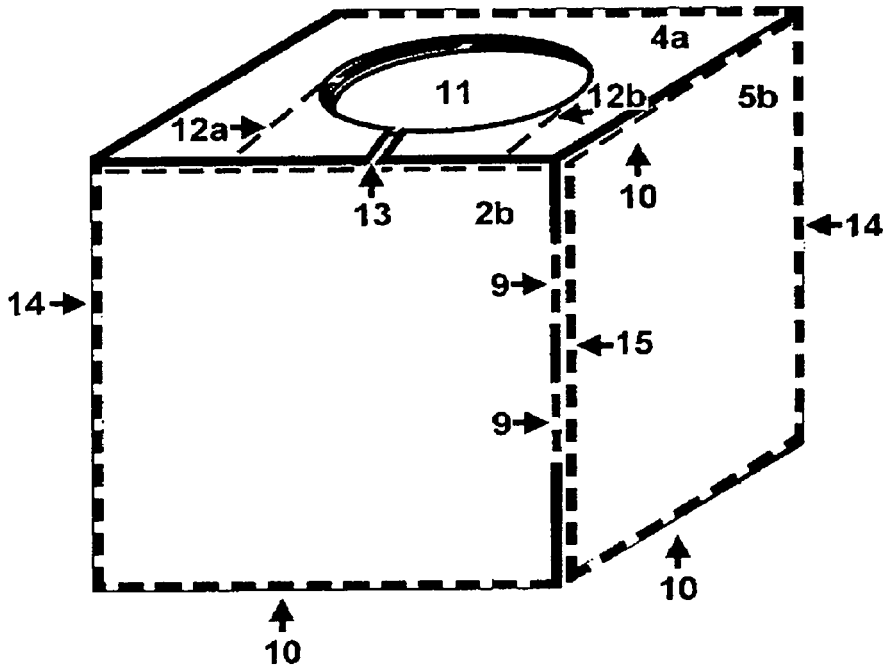

FIG. 2—Is a perspective view of FIG. 1, which is joined and partially folded FIG. 3—Is a perspective view of FIG. 1, which is joined and completely folded.

Figure 4:
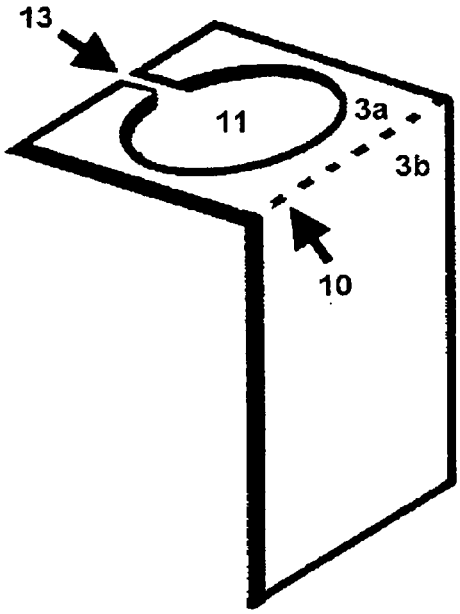

FIG. 4—Is a perspective view of an alternate embodiment of the present invention consisting of one flap without folds, and one panel.

Figure 5:
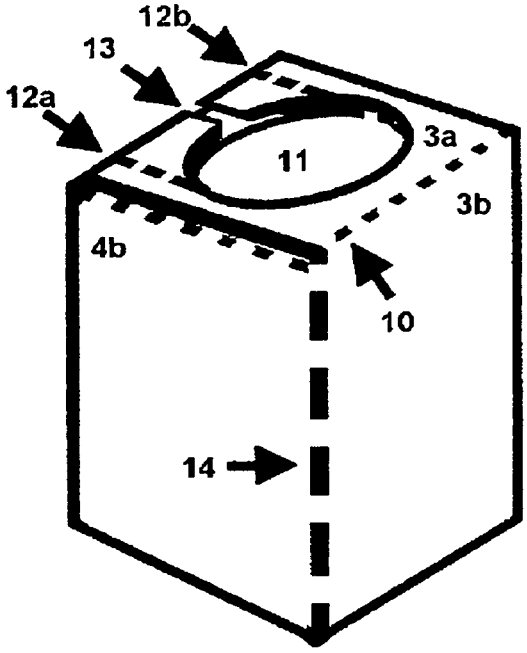

FIG. 5—Is a perspective view from the front of a second alternate embodiment of the present invention consisting of two top flaps, two bottom flaps, and two panels that are completely folded.

Figure 6:
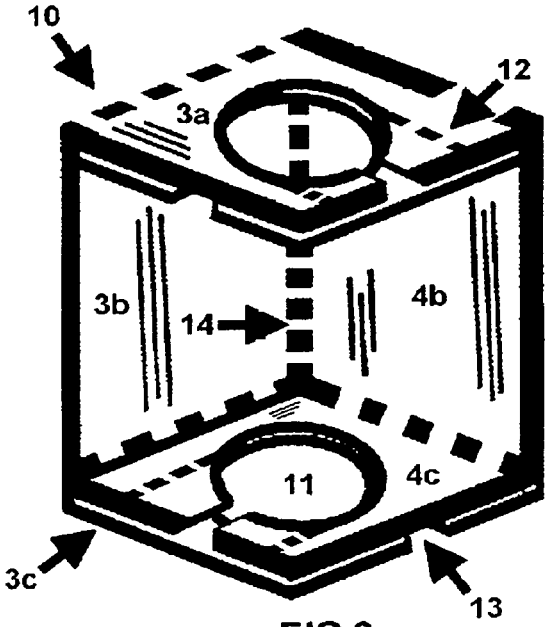

FIG. 6—Is a perspective view from the rear of FIG. 5.

Figure 7:
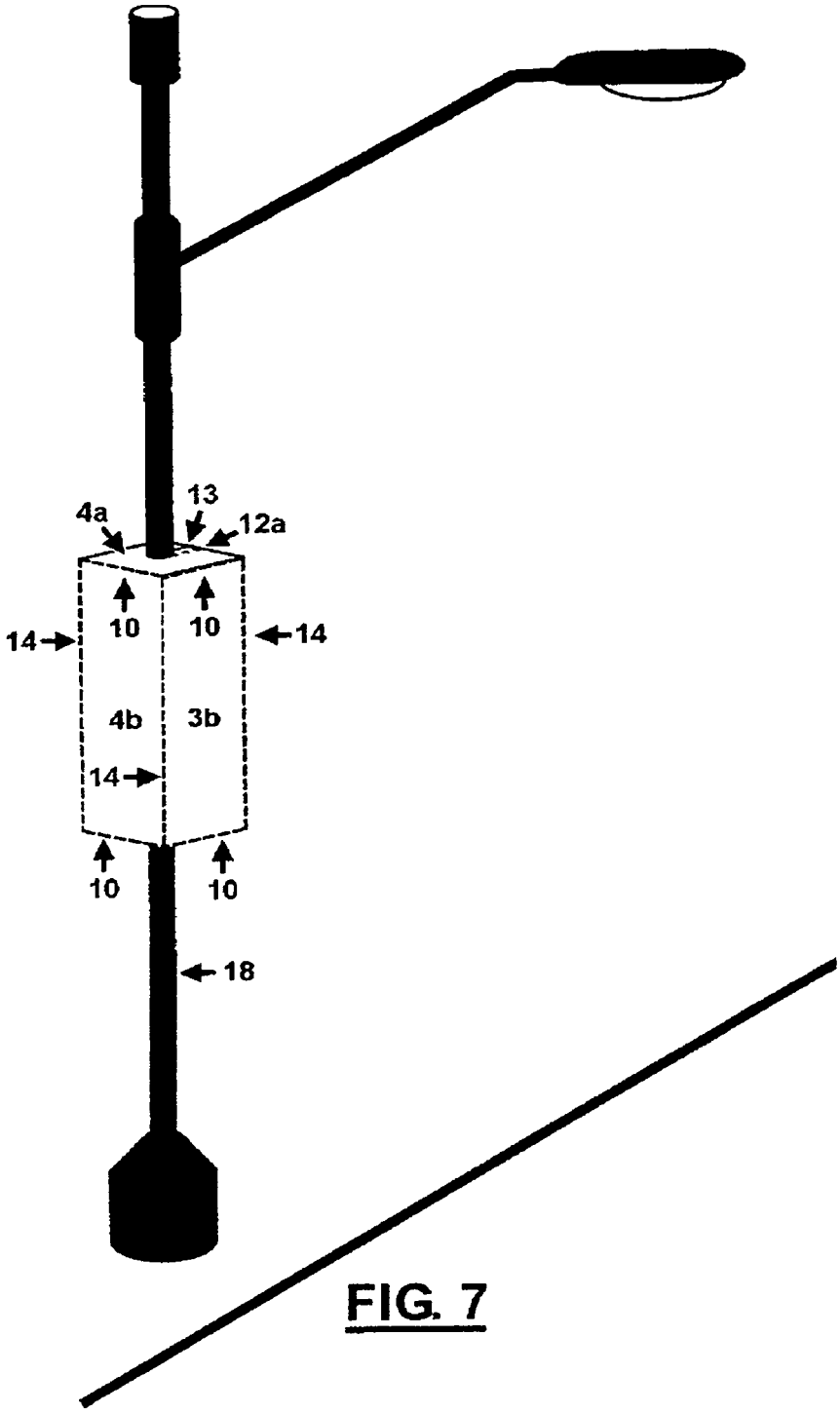

FIG. 7—Is a perspective view of FIG. 1, with longer vertical panels, which is installed.

Figure 8:
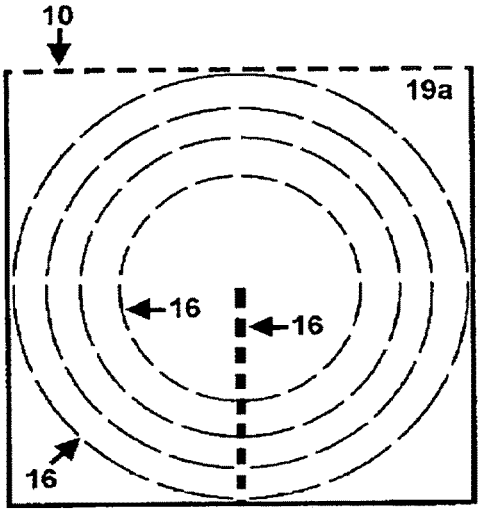

FIG. 8—Is a plan view of the top of FIG. 4 displaying an alternate flap design to provide variable apertures for multiple diameter poles.

Figure 9:
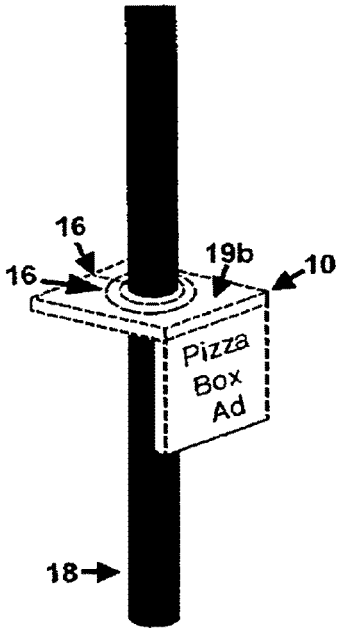

FIG. 9—Is a perspective view of FIG. 8 displaying potential use.

Figure 10:
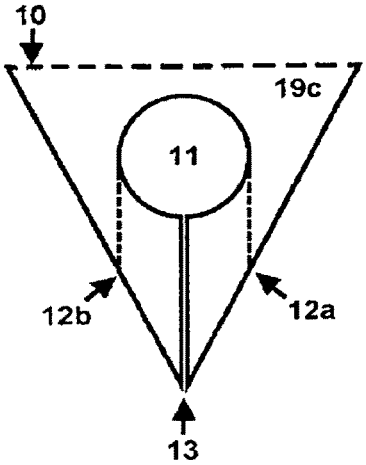

FIG. 10—Is a plan view of the flap of a third alternate embodiment, consisting of three panels, three top flaps and three bottom flaps, to create a triangular shaped figure.

Figure 11:
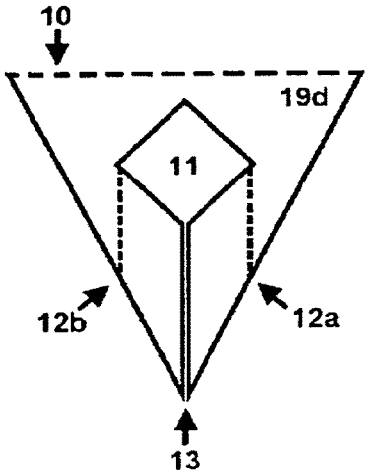

FIG. 11—Is a plan view of FIG. 10 with an alternate square shaped aperture

DRAWING NUMBERING

1) 1*a*=top tab
1*b*=bottom tab
1*c*=tab notch
2) 2*a*=tab panel, top flap
2*b*=tab panel
2*c*=tab panel, bottom flap
3) 3*a*=central panel, top flap
3*b*=central panel
3*c*=central panel, bottom flap
4) 4*a*=additional panel, top flap
4*b*=additional panel
4*c*=additional panel, bottom flap
5) 5*a*=slot panel, top flap
5*b*=slot panel
5*c*=slot panel, bottom flap
6) 6*a*=top slot
6*b*=bottom slot
7) 7=tongue
8) 8=variable height axis
9) 9=tab bend
10) 10=flap bend
11) 11=flap hole
12) 12*a*=flap fold
12*b*=flap fold
13) 13=flap cut
14) 14=panel bend
15) 15=tongue bend
16) 16=perforation
17) 17=pole sign
18) 18=light pole
19) 19*a*=alternative flap design
19*b*=alternative flap design
19*c*=alternative flap design
19*d*=alternative flap design

DETAILED DESCRIPTION OF THE SEVERAL VIEWS OF THE DRAWING(S)

FIG. 1 shows how the preassembled Polygonal Unibody Pole Sign 17 will look after it is manufactured from a single blank of cardboard or other semi-rigid material. As panels 2*b* 3*b* 4*b* 5*b* are where advertisements will be written or printed onto, each flap 2*a* 3*a* 4*a* 5*a* 2*c* 3*c* 4*c* 5*c* are identical with a flap cut 13, flap fold 12*a* 12*b*, flap hole 11, and flap bend 10 being present. Outer panel 2*b* has top tab 1*a* and bottom tab 1*b* each having a tab bend 9 and tab notch 1*c* to be used in conjunction with top slot 6*a* and bottom slot 6*b* which are cut out of tongue bend 15 between tongue 7 and panel 5*b*. The variable height axis 8 shows where leeway may be given or taken from the design to fit different advertising demands.

FIG. 2 is a three dimensional representation of the first step in the assembly of the Polygonal Unibody Pole Sign 17 listed in FIG. 1, but is missing the light pole 18 of FIG. 7 to allow room for detail. Again, as each flap 2*a* 3*a* 4*a* 5*a* 2*c* 3*c* 4*c* 5*c* is identical, the only labeled flap 2*a* shows a flap cut 13, flap fold 12*a* 12*b*, flap hole 11, and flap bend 10 to allow additional room for detail; likewise for panel bend 14. To begin, each flap 2*a* 3*a* 4*a* 5*a* 2*c* 3*c* 4*c* 5*c* should be bent away from interior at flap bend 10 to allow for easier installation. As each panel bend 14 is wrapped around, tongue 7 is bent inside at tongue bend 15 allowing top tab 1*a* and bottom tab 1*b* to be fed through the unseen top slot 6*a* and bottom slot 6*b* of FIG. 1, catching tab notch 1*c* on tongue 7, thus resting the tongue 7 on the inside of panel 2*b* and the top tab 1*a* and bottom tab 1*b* on the inside of panel 5*b*, where tongue 7 and top slot 6*a* and bottom slot 6*b* are unseen from the outside as in FIG. 3.

FIG. 3 and FIG. 7 represent opposite sides of a similar fully assembled Polygonal Unibody Pole Sign 17 from FIG. 1, but FIG. 3 is missing the light pole 18 of FIG. 7 to show flap hole 11 while giving an assembled exterior view of FIG. 2 where top tab 1*a* and bottom tab 1*b* intersect with the tongue 7 bringing panel 2*b* and panel 5*b* together. FIG. 3 best shows the differentiation between each panel bend 14 and the tongue bend 15 locked into tab bend 9 of the FIG. 2 top tab 1*a* and bottom tab 2*b*; while FIG. 7 best shows an assembled, mounted, Polygonal Unibody Pole Sign 17 from FIG. 1.

As the Polygonal Unibody Pole Sign requires few parts to function, FIG. 4 FIG. 5 and FIG. 6 can be seen as both cross sections of alternative embodiments from FIG. 3 and FIG. 7 as well as embodiments of the FIG. 1 Polygonal Unibody Pole Sign 17. Although FIG. 4 only has one panel 3*b* for advertising, it still has the single essential central panel, top flap 3*a* parts such as flap cut 13, flap hole 11, and flap bend 10 necessary to remain a self supporting platform for advertising. FIG. 5 differs from FIG. 4 with the added addition of flap fold 12*a* 12*b* to more easily encompass a pole with the unseen additional panel, top flap 4*a*, as seen in FIG. 1, and additional panel 4*b* with flap bend 10 and panel bend 14. FIG. 6 is an inside view of a two panel 3*b* 4*b*, four flap 3*a* 3*c* 4*c* and an unseen flap 4*a*, which is missing the tab panel 2*b* and slot panel 5*b* as seen in FIG. 2.

FIG. 8 illustrates an alternative flap design 19*a* of the embodiment seen in FIG. 9 in which a perforation 16 allows one product to turn into an embodiment similar to FIG. 4 with flap cut 13 by offering multiple perforation 16 lines to punch out a light post size hole for the end users to mount. In the case of FIG. 9 the perforation 16 is used to help a pizza company create additional revenue through increasing advertising opportunities on a product which is already being sold.

FIG. 10 is an alternative flap design 19*c* which is for a three panel embodiment which has a circular flap hole 11 to fit around a circular pole. FIG. 11 is an alternative flap design 19*d* which is for a three panel embodiment which has a square flap hole 11 to fit around a square pole.

DETAILED DESCRIPTION OF THE INVENTION

A Polygonal Unibody Pole Sign 17 contains multiple, full overlap flaps 2*a* 3*a* 4*a* 5*a* 2*c* 3*c* 4*c* 5*c* along the top and bottom (along the horizontal sides), a tab or tabs 1*a* 1*b* along one vertical side, with a corresponding slot or slots 6*a* 6*b* along the opposite vertical side, and multiple panels 2*b* 3*b* 4*b* 5*b* (panel numbers depend upon the direction of the intended advertisement and/or function: one direction=one panel, two directions=two side by side panels, three direction=triangular box, four directions=cube or rectangular box, and so forth). Each flap 2*a* 3*a* 4*a* 5*a* 2*c* 3*c* 4*c* 5*c* contains a central circular or other shaped aperture 11 (mirroring the pole 18 for which the flap will surround), a single cut 13 on the far side of the aperture 11 away from the panel 2*b* 3*b* 4*b* 5*b* for which the flap 2*a* 3*a* 4*a* 5*a* 2*c* 3*c* 4*c* 5*c* is attached; thus dividing each flap 2*a* 3*a* 4*a* 5*a* 2*c* 3*c* 4*c* 5*c* to allow the pole 18 to enter the aperture 11, and two folds 12*a* 12*b* on opposite sides, parallel to the cut 13 equal to the diameter of the attaching pole 18 allowing it to pass between the folds 12*a* 12*b* when opened. Each tab 1*a* 1*b* width is equal the width of that tabs 1*a* 1*b* corresponding slot 6*a* 6*b*, but is positioned lower by the height of the notch 1*c* in that tab 1*a* 1*b*; so when that tab is inserted into the corresponding slot 6*a* 6*b* the tab notch 1*c* rests within the bottom of the slot 6*a* 6*b*, thus holding the two vertical panels together. Each slot or slots 6*a* 6*b* are located on the bend 15 on tongue 7 closest to slot panel 5*b*.

A Polygonal Unibody Pole Sign 17 is installed by (a single user) bending the panels 2*b* 3*b* 4*b* 5*b* around an appropriate pole 18 with the tongue 7 inside of the Polygonal Unibody Pole Sign 17. Then bending all flaps 2*a* 3*a* 4*a* 5*a* 2*c* 3*c* 4*c* 5*c* outward, and placing Polygonal Unibody Pole Sign 17 on ground. Then feed tabs 1*a* 1*b* into slots 6*a* 6*b* reaching inside Pole Sign 17 from top (and bottom if necessary) to pull tabs 1*a* 1*b* through to rest on last tab notch 1*c*, until tab panel 2*b* and slot panel 5*b* are end to end on the outside of the Polygonal Unibody Pole Sign 17, and the tabs 1*a* 1*b* and tongue 7 are on the inside of the Polygonal Unibody Pole Sign 17. Then lift Polygonal Unibody Pole Sign 17 to intended height making sure panel(s) 2*b* 3*b* 4*b* 5*b* (if used for advertising) are facing the desired audience location before placing flap(s) 2*a* 3*a* 4*a* 5*a* 2*c* 3*c* 4*c* 5*c* onto pole 18. Bend slot panel 5*b*, bottom flap 5*c* under affixing onto pole 18. Then bend panel tab 2*b*, bottom flap 2*c* under affixing onto pole 18. Bend and affix the rest of the panel(s) 3*b* 4*b*, bottom flap(s) 3*c* 4*c* clockwise onto the pole 18. Beginning with the slot panel 5*b*, bend and affix all panel(s) 2*b* 3*b* 4*b* top flaps 2*a* 3*a* 4*a* clockwise to the pole 18.

What is claimed is:

1. A polygonal unibody pole sign comprising: a blank having a first flat configuration and foldable into a three dimension configuration; the blank having a first panel, a second panel adjacent the first panel about a first fold, a third panel adjacent the second panel about a second fold opposite the first fold and a fourth panel adjacent the third panel about a third fold opposite the second fold; each panel has aligned first edges and aligned second edges opposite the first edges; each panel has a first flap extending from the first edge about a first edge fold and a second flap extending from the second edge about a about a second edge fold, wherein each flap has a central aperture, a central slot extending from the central aperture to an outside edge opposite the panel, a first perforated line spaced from one side of the central slot and a second perforated line spaced from the second opposite side of the central slot; a first and second tab extending from the first panel and a tongue extending from the forth panel; a pair of spaced slots in the tongue adapted to receive the first and second tabs when the panels are folded about the first second and third folds.

* * * * *